US011337503B2

(12) United States Patent
Kim

(10) Patent No.: US 11,337,503 B2
(45) Date of Patent: May 24, 2022

(54) FOUNDATION CONTAINER HAVING DISCHARGE PUMP THEREIN

(71) Applicant: Jin Woo Kim, Anyang-si (KR)

(72) Inventor: Jin Woo Kim, Anyang-si (KR)

( * ) Notice: Subject to any disclaimer, the term of this patent is extended or adjusted under 35 U.S.C. 154(b) by 24 days.

(21) Appl. No.: 16/634,670

(22) PCT Filed: Dec. 6, 2018

(86) PCT No.: PCT/KR2018/015417
§ 371 (c)(1),
(2) Date: Jan. 28, 2020

(87) PCT Pub. No.: WO2020/009289
PCT Pub. Date: Jan. 9, 2020

(65) Prior Publication Data

US 2020/0205544 A1 Jul. 2, 2020

(30) Foreign Application Priority Data

Jul. 4, 2018 (KR) ..... 10-2018-0077413

(51) Int. Cl.
*A45D 33/02* (2006.01)
*A45D 40/22* (2006.01)
(Continued)

(52) U.S. Cl.
CPC ..... *A45D 33/02* (2013.01); *A45D 33/025* (2013.01); *A45D 34/04* (2013.01);
(Continued)

(58) Field of Classification Search
CPC ..... A45D 33/00; A45D 33/02; A45D 33/06; A45D 33/16; A45D 40/221;
(Continued)

(56) References Cited

U.S. PATENT DOCUMENTS 5,411,182 A * 5/1995 Marte ..... B65D 83/0044 222/386
2016/0227903 A1 8/2016 Kang
(Continued)

FOREIGN PATENT DOCUMENTS

FR 2903092 A1 * 1/2008 ..... A45D 40/0075
KR 200479429 Y1 * 2/2016 ..... A45D 34/00
(Continued)

*Primary Examiner* — Jacqueline T Johanas
*Assistant Examiner* — Madison E Bondoc
(74) *Attorney, Agent, or Firm* — John K. Park; Park Law Firm

(57) ABSTRACT

Disclosed is a foundation container having a discharge pump therein, in which a contents container of stretchable material for storing cosmetic contents is coupled inside a container main body, and is fixed by a middle cap, and the contents container is provided with a rounded curved portion (42) at a lower edge thereof, an annular bent portion (43) at a lower center portion thereof, and spaced protrusions (44) protruding radially on an upper bottom surface, such that the contents container is evenly pressed from the rounded curved portion during the pumping operation of the pump, and even when the contents container is compressed, the gap is secured to discharge minimal contents, whereby the contents are smoothly discharged, and by the branch structure of the distribution plate and the discharge plate, it is possible to minimize the residual contents and improve use efficiency while discharging the cosmetic contents evenly.

7 Claims, 9 Drawing Sheets

(51) Int. Cl.
*A45D 34/04* (2006.01)
*A45D 40/00* (2006.01)

(52) U.S. Cl.
CPC ..... *A45D 40/0075* (2013.01); *A45D 40/22* (2013.01); *A45D 2200/056* (2013.01)

(58) Field of Classification Search
CPC ..... A45D 40/0075; A45D 33/025; A45D 220/054; A45D 220/056; A45D 34/00; A45D 2040/233; A45D 34/04; A45D 40/26; A45D 2200/05; A45D 2200/51; A45D 2200/18; A45D 40/0068; A45D 33/003; A45D 33/006; A45D 33/008; A45D 33/04–16; A45D 33/18; A45D 33/22; A45D 33/24; A45D 40/22–222; A45D 40/24; A45D 2040/223–228; B05B 11/3047; B05B 11/30; B05B 11/3001
USPC ..... 132/286, 293–307, 314, 315; 222/405
See application file for complete search history.

(56) References Cited

U.S. PATENT DOCUMENTS

| | | | | |
|---|---|---|---|---|
| 2017/0049213 | A1* | 2/2017 | Kang | B05B 11/00416 |
| 2017/0318938 | A1* | 11/2017 | Lee | A45D 34/00 |

FOREIGN PATENT DOCUMENTS

| | | | | |
|---|---|---|---|---|
| KR | 2020160002144 U | 6/2016 | | |
| KR | 101796899 B1 | 11/2017 | | |
| KR | 2020170003816 U | 11/2017 | | |
| KR | 2018014418 A * | 2/2018 | | A45D 33/008 |
| KR | 101915937 B1 | 11/2018 | | |

* cited by examiner

[Fig. 1]
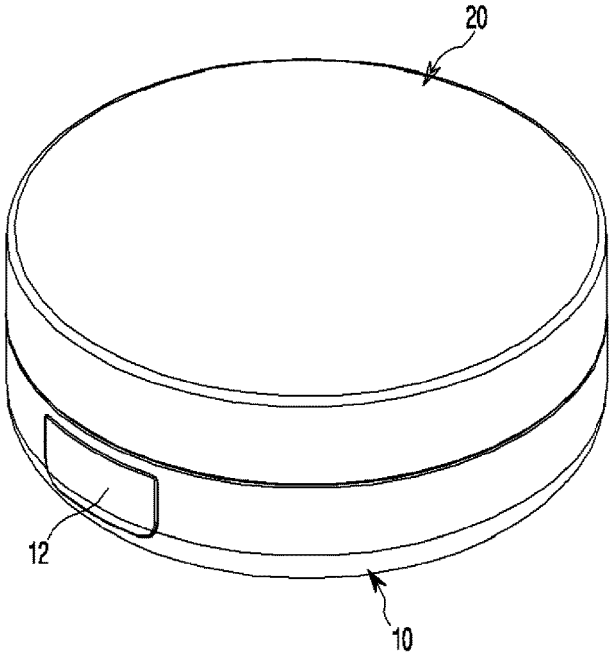
[Fig. 2]
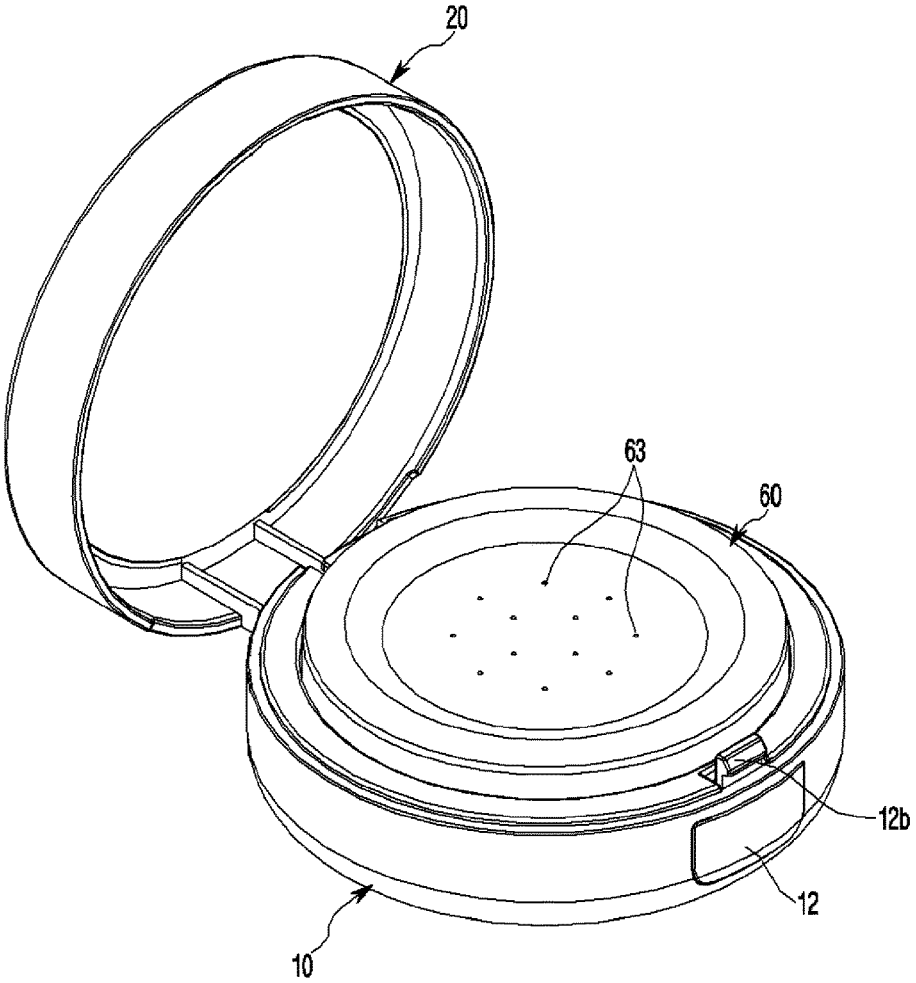

[Fig. 3]
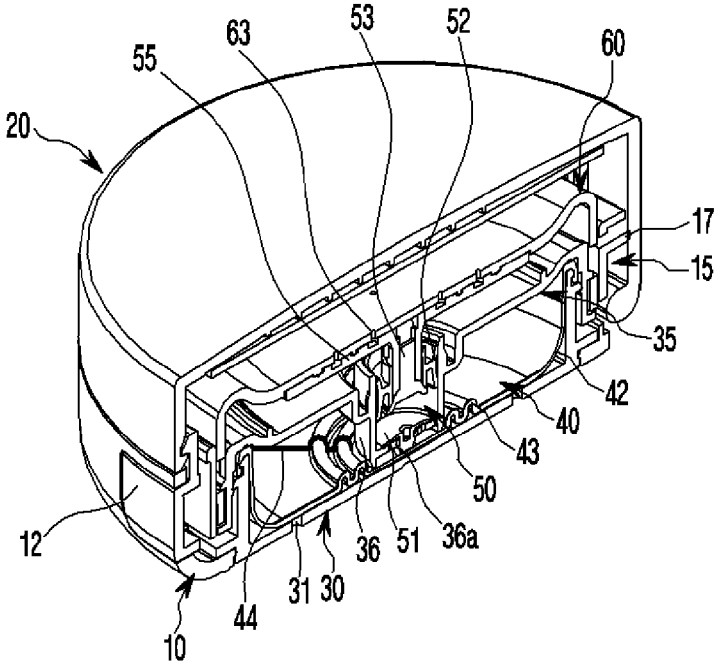
[Fig. 4]
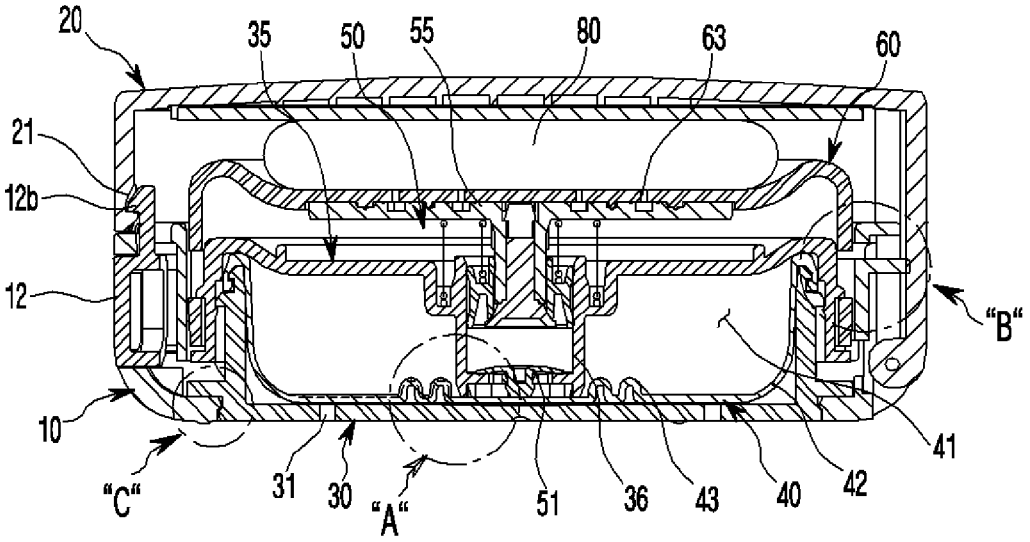

[Fig. 5]
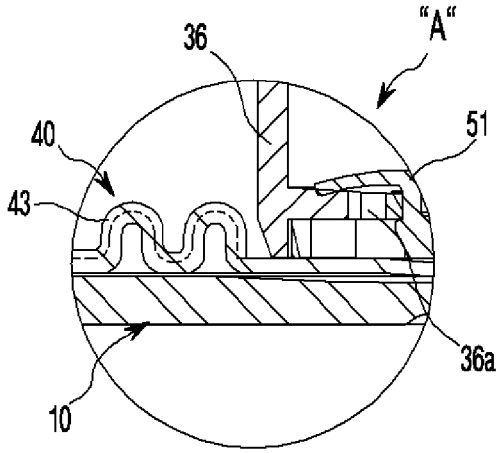
[Fig. 6]
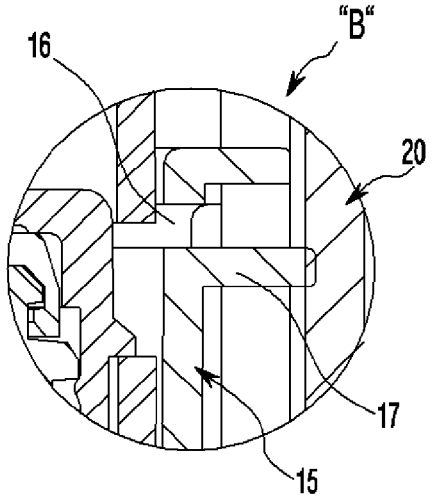
[Fig. 7]
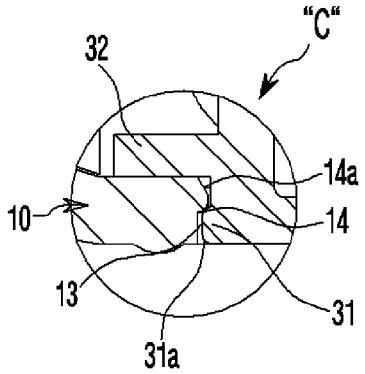

[Fig. 8]
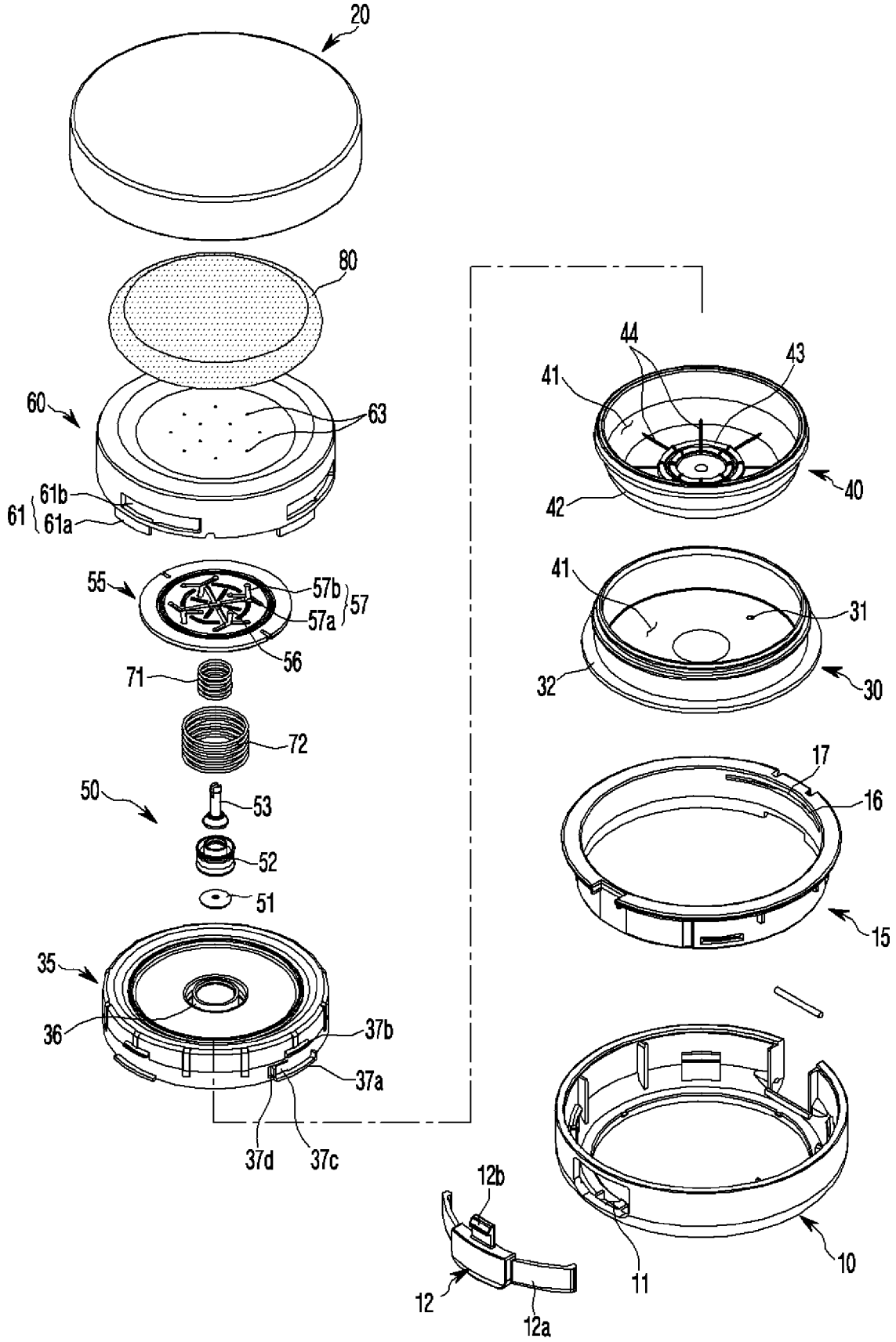

[Fig. 9]
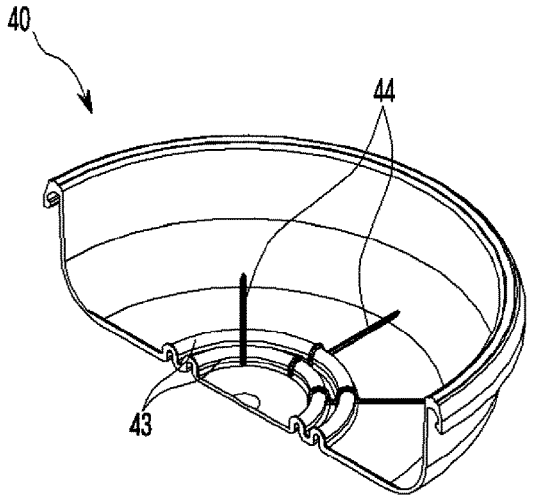
[Fig. 10]
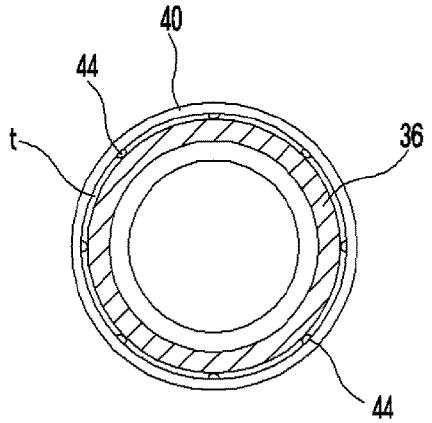
[Fig. 11]
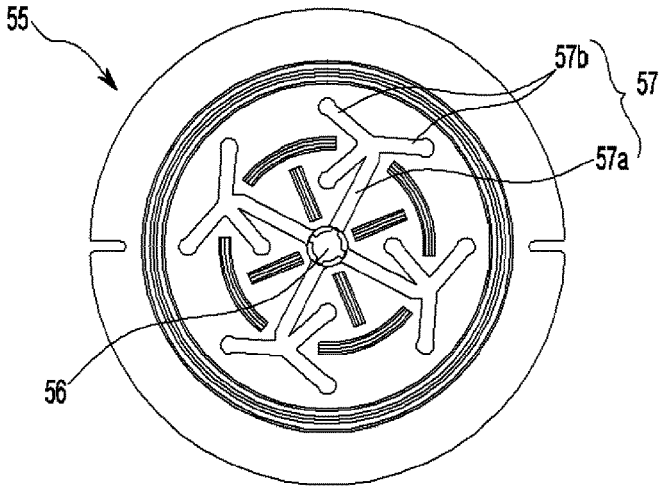

[Fig. 12]
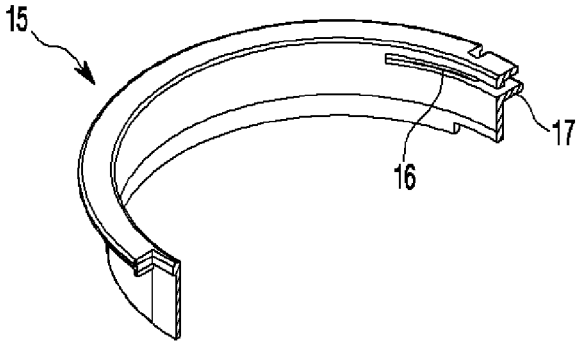

[Fig. 13]
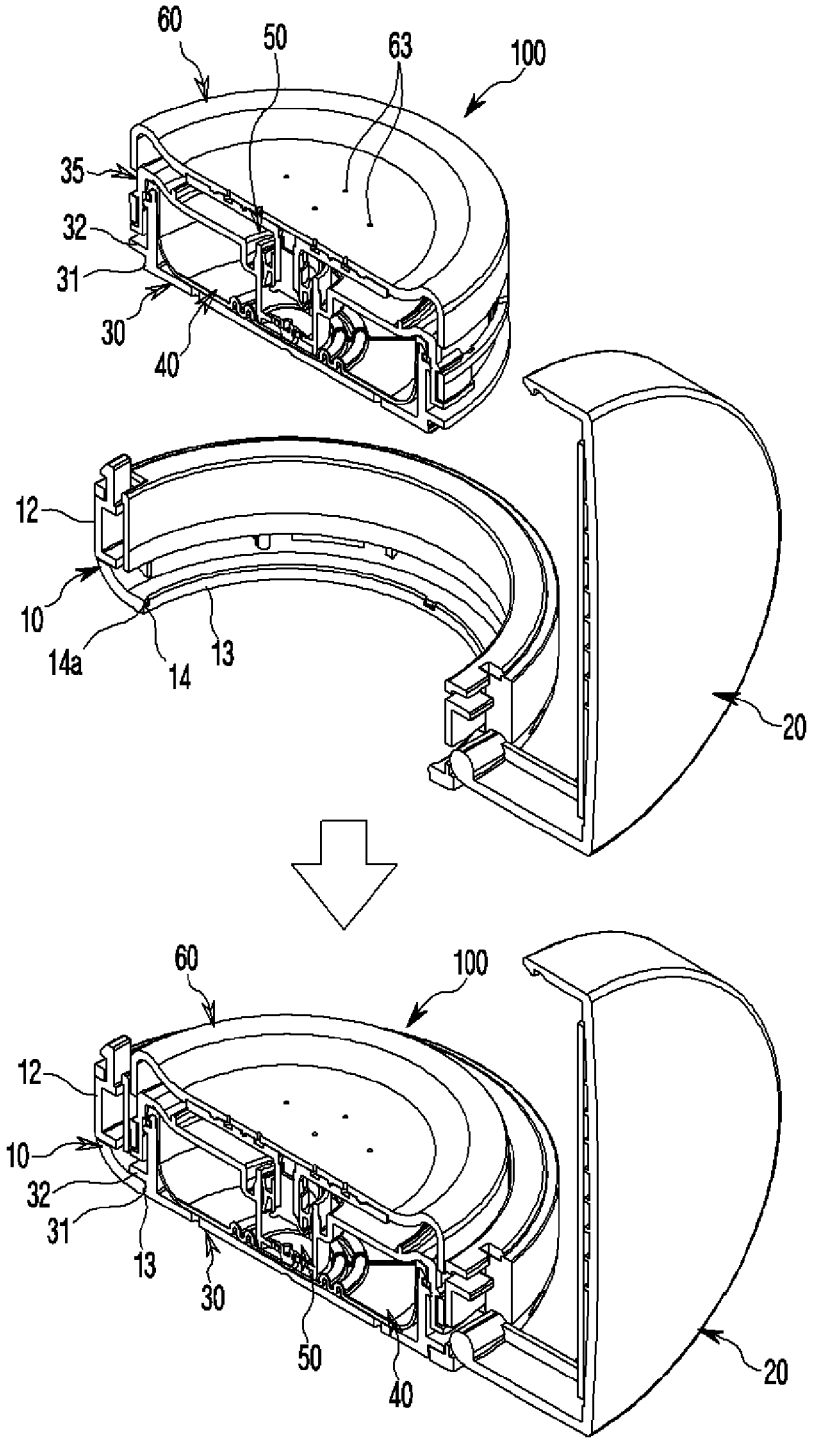

[Fig. 14]
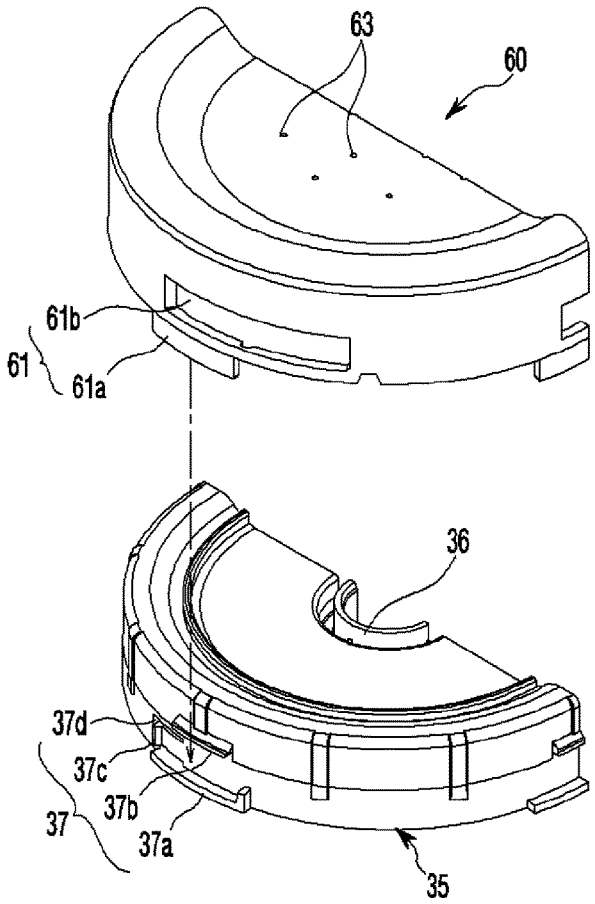
[Fig. 15]
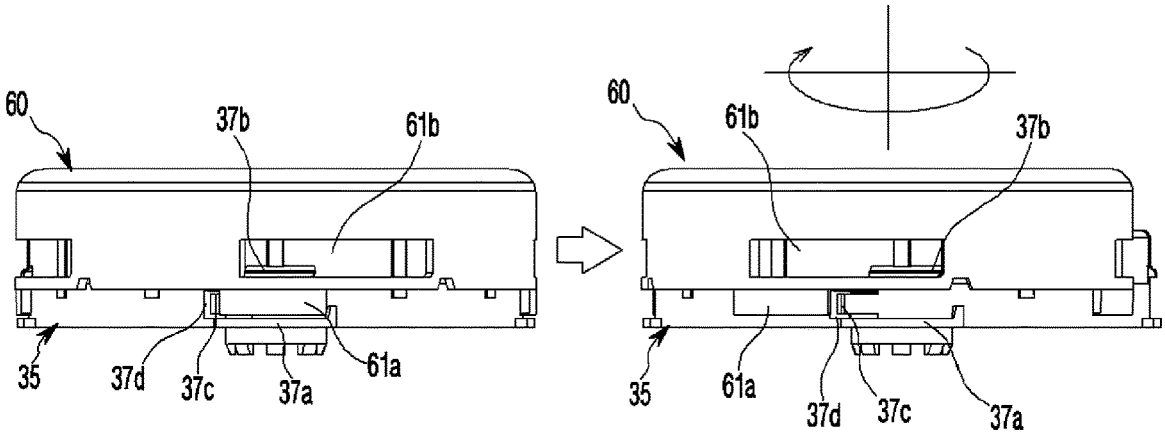

[Fig. 16]
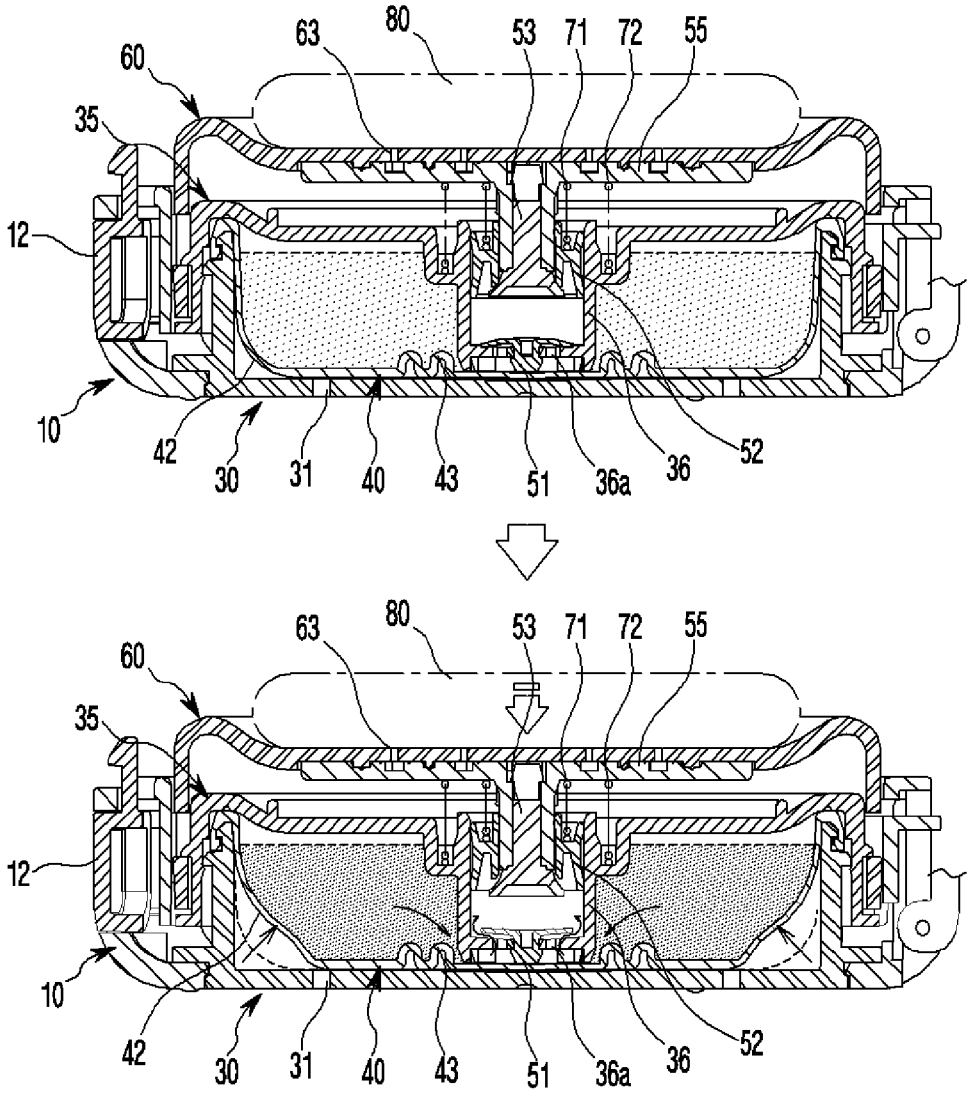

FOUNDATION CONTAINER HAVING DISCHARGE PUMP THEREIN

TECHNICAL FIELD

The present invention relates generally to a foundation container having a discharge pump therein, in which a discharge plate above a container main body is pressed to discharge contents in the container main body by a pumping operation of a pump. More particularly, the present invention relates to a foundation container having a discharge pump therein, in which contents are contained in a contents container of stretchable material inside the container main body, and the contents container is gradually compressed from an outer lower side to a center thereof by pumping operation of a pump to evenly distribute and discharge the contents, thereby minimizing the remaining amount of the contents compared to the conventional container.

BACKGROUND ART

In general, foundations are used for a base makeup and are used to make skin colors uniform and to cover defects. Foundations are classified into solid, liquid or gel types.

The solid foundation has a good covering power, but it has a disadvantage that it is cakey during makeup correction. The liquid foundation has a good adhesion, but it has a weak sustainability. Thus, in recent years, there has been an increase in the number of consumers who prefer the gel foundation having a considerable sustainability and good adhesion properties for skin application.

The gel foundation is conventionally contained in a glass container or a tube container, and is taken out to the user's hand or squeezed and applied to the skin with puff or by hand. However, it is disadvantageous in that since the cosmetic is used by taking it out to the hand, a user should wash hands every time it is used.

To solve the above problem, as in Korean Utility Model Registration No. 20-0470757 (Patent Document 1), there has been disclosed a compact container having an airless pump, which is configured such that between an outer container and a lid, a container main body, a pump, a discharge plate are coupled to each other, and the discharge plate is elastically pressed such that cosmetic contents in the container main body are pumped out and discharged to the discharge plate, and are used with a puff or the like, whereby there is no need to take out the contents by hand, and it is possible to easily carry the compact container.

However, the conventional compact container having an airless pump is disadvantageous in that since, in order to effectively discharge the contents inside the container main body during the pumping operation of the pump, the container main body is provided with a piston at the inner bottom thereof, so that the piston is raised while discharging the contents during the pumping operation of the pump, in the case of the above piston type, the airtightness is deteriorated due to the horizontal disparity thereof, and it is difficult to discharge all the final residual contents, which lowers the user satisfaction considerably.

The conventional compact container is further disadvantageous in that since a contents container of rubber material having elasticity is mounted in the container main body, the contents are discharged while the contents container is pressed during the pumping operation of the pump, the contents container has good airtightness but is not pressed evenly by the pumping force of the pump, and in particular, the contents container is pressed firstly around contents discharge holes, which interferes with the discharge of the contents, so that the discharge of the contents is not smooth, and it is difficult to discharge all the final residual contents, which lowers the user satisfaction considerably.

Therefore, the applicant of the present invention has sought to develop an improved product, which facilitates the discharge of contents, whereby a contents container is evenly compressed by the pumping operation of the pump to minimize the final residual contents, while using a contents container of rubber material having elasticity.

DOCUMENTS OF RELATED ART (Patent Document 1) Korean Utility Model Registration No. 20-0470757 (published Sep. 1, 2014)
(Patent Document 2) Korean Utility Model Registration No. 20-0480194 (published Apr. 22, 2016)
(Patent Document 3) Korean Utility Model Registration No. 20-0481481 (published Oct. 6, 2016)

DISCLOSURE

Technical Problem

Accordingly, the present invention has been made keeping in mind the above problems occurring in the related art, and an object of the present invention is to provide a foundation container having a discharge pump therein, in which contents are contained in a contents container of stretchable material inside the container main body, and the contents container is gradually compressed from an outer lower side to a center thereof by pumping operation of a pump to evenly distribute and discharge the contents, thereby minimizing the remaining amount of the contents compared to the conventional container, and improving use efficiency.

Another object of the present invention is to provide a foundation container having a discharge pump therein, in which a refill container, to which a container main body, a middle cap, a contents container, a pump, and a discharge plate are integrally coupled, is simply inserted into an outer container to enable refill use, whereby it is possible to improve economic feasibility and efficiency.

A further object of the present invention is to provide a foundation container having a discharge pump therein, in which by a locking structure by a discharge plate, a stop portion, and a support portion of a middle cap, the pressing operation of the pump is not performed when initially used, and only after unlocking by rotating the discharge plate, the pumping operation is enabled by the pressing operation of the pump, whereby it is possible to prevent malfunctions.

Technical Solution

In order to achieve the above object, according to some aspect of the present invention, there is provided a foundation container having a discharge pump therein, the foundation container including: an outer container; a lid hinged to the outer container to be opened and closed vertically; a container main body mounted in the outer container; a pump coupled to an upper center portion of the container main body; and a discharge plate coupled to an upper portion of the pump, and formed with contents discharge holes, wherein the container main body is provided with a ventilation hole formed through a lower portion thereof, a contents container of stretchable material having a space portion for storing contents is inserted in the container main body, and an upper end of the contents container is seated on an upper portion of the container main body to be fixedly coupled by a middle cap coupled to the upper portion of the container main body, such that the contents container is gradually pressed by pumping operation of the pump by elastic pressing action of the discharge plate, so as to discharge the contents to the contents discharge holes of the discharge plate.

According to the present invention, the contents container is configured such that a lower edge thereof is provided with a rounded curved portion and a bottom thereof is provided with at least one annular bent portion formed to be bent upward and downward at a position outside a pump accommodating portion of a lower center portion of the middle cap, so as to induce the contents container to be gradually pressed from the rounded curved portion thereof.

According to the present invention, the contents container is provided on an upper bottom surface thereof with spaced protrusions protruding radially to form a gap for discharging the contents from an outer wall surface of the pump accommodating portion of the middle cap when the contents container is pressed.

According to the present invention, the outer container may be coupled to a coupling ring body to fix an inserted state of a button for opening and closing the lid in an assembly hole formed at a front of the outer container, wherein the coupling ring body is integrally provided at a back thereof with a slit cut in a circumferential direction, and a tension protrusion protruding from a center of the slit to provide a tension force at an initial stage of opening the lid.

According to the present invention, a distribution plate coupled to an upper portion of a piston rod of the pump may be provided at an upper portion thereof with branch passages formed radially at an equal angle interval from a contents supply hole at a center of the distribution plate to discharge the contents evenly to the discharge plate, each of the branch passages having a first branch passage for guiding discharge of the contents from the contents supply hole, and at least two second branch passages configured such that the second branch passages are branched in different directions at an end of the first branch passage to guide discharge of the contents and the contents discharge holes of the discharge plate are disposed to be aligned with end portions of the second branch passages.

According to the present invention, a refill container with the container main body, the middle cap, the contents container, the pump, and the discharge plate coupled thereto may be integrally provided and inserted in the outer container for refill use, the outer container may be formed at a bottom thereof with an annular assembly hole, and a stop step having an inclined portion inclined from an upper portion to a lower portion thereof at an upper edge of the assembly hole, and the container main body may include: a ring-shaped coupling protrusion provided on an outer lower side thereof to be inserted into an assembly hole of the outer container to prevent separation, with a lower edge thereof formed with a rounded portion; and a seat protrusion provided at a position above the coupling protrusion to be seated in an inner bottom of the outer container.

According to the present invention, the outer container may be further provided with a knurling portion on a circumferential surface of an upper bottom thereof, and the seat protrusion of the container main body may be further provided with a support protrusion on a lower surface thereof to be engaged with the knurling portion to prevent rotation.

According to the present invention, the discharge plate may be provided on an outer side thereof radially at an equal angle interval with stop portions each having a stop protrusion at a lower portion of the outer side and a stop groove at a position above the stop protrusion, and the middle cap may be provided on an outer side thereof radially at an equal angle interval to correspond to the stop portions with support portions each having a lower support protrusion for supporting the stop protrusion of the discharge plate to restrict rotation of the stop protrusion toward lower and first sides thereof, an upper support protrusion for supporting an upper portion of the discharge plate, and a side support protrusion for engagement with the stop portion while being tensioned inward and outward by a slit formed on a second side thereof, whereby, at initial use, the stop portion of the discharge plate is forcibly rotated to be separated from the side support protrusion of the support portion, such that the discharge plate is released from a locked state to enable the pump to be operated.

Advantageous Effects

According to the present invention, it is advantageous in that since the contents container of stretchable material for storing cosmetic contents is coupled inside the container main body, and is fixed by the middle cap, and the contents container is provided with a rounded curved portion at a lower edge thereof, an annular bent portion bent upward and downward at a lower center portion thereof, and spaced protrusions protruding radially on an upper bottom surface, such that the contents container is evenly pressed from the rounded curved portion of the lower edge during the pumping operation of the pump, and even when the contents container is compressed, the gap is secured to discharge minimal contents, whereby the contents are smoothly discharged, and by the branch structure of the distribution plate and the discharge plate, it is possible to minimize the residual contents and improve use efficiency while discharging the cosmetic contents evenly.

In addition, the present invention is advantageous in that a refill container, to which a container main body, a middle cap, a contents container, a pump, and a discharge plate are integrally coupled, is simply inserted into an outer container to enable refill use, whereby it is possible to improve economic feasibility and efficiency. Further, by a locking structure by a discharge plate, a stop portion, and a support portion of a middle cap, the pressing operation of the pump is not performed when initially used, and only after unlocking by rotating the discharge plate, the pumping operation is enabled by the pressing operation of the pump, whereby it is possible to prevent malfunctions, and is possible to prevent contamination of the container and around the container due to cosmetic contents discharge by malfunction.

DESCRIPTION OF THE DRAWINGS

FIG. 1 is an outside perspective view showing a container of the present invention;

FIG. 2 is an outside perspective view showing an opened state of a lid of FIG. 1;

FIG. 3 is a half-sectional perspective view of FIG. 1;

FIG. 4 is a sectional view of FIG. 1;

FIGS. 5 to 7 are partial enlarged views of "A", "B", "C" of FIG. 4;

FIG. 8 is an exploded perspective view showing the container of the present invention;

FIG. 9 is a half-sectional perspective view showing a contents container of the present invention;

FIG. 10 is a plan view of an important portion showing a state where the contents container of the present invention is brought into close contact with an outside of a pump accommodating portion of a middle cap;

FIG. 11 is a plan view showing a distribution plate of the present invention;

FIG. 12 is a half-sectional perspective view showing the middle cap of the present invention;

FIG. 13 is a half-sectional perspective view showing a structure of before and after coupling a refill container of the present invention;

FIG. 14 is an exploded perspective view of an important portion showing a locking structure of the refill container of the present invention;

FIG. 15 is a front view of an important portion showing a structure of before and after operation of FIG. 14; and FIG. 16 is a sectional view showing a state of use of the container of the present invention to discharge contents.

MODE FOR INVENTION

Hereinbelow, an exemplary embodiment of the present invention will be described in detail with reference to the accompanying drawings.

A foundation container having a discharge pump therein of the present invention, as shown in FIGS. 1 to 15, includes: an outer container 10; a lid 20 hinged to the outer container 10 to be opened and closed vertically; a container main body 30 mounted in the outer container 10; a pump 50 coupled to an upper center portion of the container main body 30; and a discharge plate 60 coupled to an upper portion of the pump 50 and formed with contents discharge holes 63.

In particular, the container main body 30 is provided with a ventilation hole 31 formed through a lower portion thereof, a contents container 40 of stretchable material (for example, rubber materials such as urethane to prevent deterioration of cosmetic contents) having a space portion 41 for storing contents is inserted in the container main body, and an upper end of the contents container 40 is seated on an upper portion of the container main body to be fixedly coupled by a middle cap 35 coupled to the upper portion of the container main body, such that the contents container 40 is gradually pressed by pumping operation of the pump 50 by elastic pressing action of the discharge plate 60, so as to discharge the contents to the contents discharge holes 63 of the discharge plate.

Here, the contents container 40 is configured such that a lower edge thereof is provided with a rounded curved portion 42, and a bottom thereof is provided with at least one annular bent portion 43 formed to be bent upward and downward at a position outside a pump accommodating portion 36 of a lower center portion of the middle cap 35, so as to induce the contents container to be gradually pressed from the rounded curved portion of the contents container.

Further, the contents container 40 is provided on an upper bottom surface thereof with spaced protrusions 44 protruding radially to form a gap t for discharging the contents from an outer wall surface of the pump accommodating portion 36 of the middle cap when the contents container is pressed.

The outer container 10 is coupled to a coupling ring body 15 to fix an inserted state of a button 12 for opening and closing the lid 20 in an assembly hole 11 formed at a front of the outer container.

Here, the button 12 is provided with right and left tension pieces 12*a*, a locking protrusion 12*b* protruding from an upper portion thereof to perform locking operation by being engaged with a locking groove 21 of the lid.

Further, the coupling ring body 15 is integrally provided at a back thereof with a slit 16 cut in a circumferential direction, and a tension protrusion 17 protruding from a center of the slit to provide a tension force at an initial stage of opening the lid 20, such that, compared to the conventional case where a tension protrusion is separately provided, it simplifies the structure and further improves tension operation by slit 16 space.

The pump 50 includes: a check valve 51 configured to open and close a through-hole 36*a* formed through a bottom of the pump accommodating portion 36 at the lower center portion of the middle cap; a fixed piston 52 inside the pump accommodating portion; a piston rod 53 configured to open and close a discharge path of the cosmetic contents by vertically moving in the fixed piston; and a distribution plate 55 coupled to an upper portion of the piston rod to distribute the contents pumped out, wherein the distribution plate 55 is bonded to a coupling groove 65 formed in the lower portion of the discharge plate by ultrasonic bonding.

Herein, the distribution plate 55 is provided at an upper portion thereof with branch passages 57 formed radially at an equal angle interval from a contents supply hole 56 at a center of the distribution plate to discharge the contents evenly to the discharge plate, each of the branch passages having a first branch passage 57*a* for guiding discharge of the contents, and at least two second branch passages 57*b* configured such that the second branch passages are branched in different directions at an end of the first branch passage to guide discharge of the contents and the contents discharge holes 63 of the discharge plate 60 are disposed to be aligned with end portions of the second branch passages.

Meanwhile, the container of the present invention is integrally provided with a refill container 100 coupled with the container main body 30, the middle cap 35, the contents container 40, the pump 50, and the discharge plate 60, for refill use by being inserted into the outer container 10.

Here, the outer container 10 is formed at a bottom thereof with an annular assembly hole 13, and a stop step 14 having an inclined portion 14*a* inclined from an upper portion to a lower portion thereof at an upper edge of the assembly hole. The container main body 30 includes: a ring-shaped coupling protrusion 32 provided on an outer lower side thereof to be inserted into the assembly hole 13 of the outer container to prevent separation, with a lower edge thereof formed with a rounded portion 32*a*; and a seat protrusion 33 provided at a position above the coupling protrusion to be seated in an inner bottom of the outer container.

Herein, the outer container 10 may be further provided with a knurling portion 18 on a circumferential surface of an upper bottom thereof, and the seat protrusion 33 of the container main body 30 may be further provided with a support protrusion 34 on a lower surface thereof to be engaged with the knurling portion 18 to prevent rotation.

It is possible to prevent the container main body 30 from loosening with respect to the outer container 10 during the unlocking operation of the discharge plate 60 through the configuration of the knurling portion 18 and the support protrusion 34.

Further, the container of the present invention is configured such that, when initially provided, the pumping operation of the pump 50 by the discharge plate 60 is restricted by a locking structure to prevent malfunctions, wherein the locking structure is configured such that the discharge plate 60 is provided in an outer side thereof radially at an equal angle interval with stop portions 61 each having a stop protrusion 61*a* at a lower portion of the outer side and a stop groove 61*b* at a position above the stop protrusion, and the middle cap 35 is provided in an outer side thereof radially at an equal angle interval to correspond to the stop portion 61 with a support portion 37 having a lower support protrusion 37*a* for supporting the stop protrusion 61*a* of the discharge plate to restrict rotation toward lower and first sides thereof, an upper support protrusion 37*b* for supporting an upper portion of the discharge plate, and a side support protrusion 37*c* for engagement while being tensioned inward and outward by a slit 37*d* formed on a second side thereof, whereby, at initial use, the stop portion 61 of the discharge plate is forcibly rotated to be separated from the side support protrusion 37*c* of the support portion, such that the discharge plate is released from a locked state to enable the pump to be operated.

Herein, when the discharge plate 60 is forcibly rotated, the middle cap 35, the contents container 40, and the container main body 30 are prevented from being rotated by the knurling portion 18 of the outer container 10 and the support protrusion 34 of the container main body 30 being engaged with each other.

As the unexplained reference numerals, reference numerals 71 and 72 denote an elastic spring, and reference numeral 80 denotes a puff.

Hereinafter, the operation and effect of the present invention configured as described above will be described.

Firstly, the button 12 at the front of the outer container 10 is pressed to unlock the lid 20.

The tension protrusion 17 of the coupling ring body 15 coupled to the inside of the outer container pushes the unlocked lid 20, and a user rotates the partially opened lid 20 to fully open the lid 20.

Here, the tension protrusion 17 of the coupling ring body 15 is operated by a simple structure integrally formed with the coupling ring body 15 instead of a conventional structure in which urethane rubber or the like is fitted separately, wherein the tension protrusion 17 is integrally protrudingly formed with the center of the slit 16 cut at the back of the coupling ring body in the circumferential direction to simplify the assembly structure, and also, the tension protrusion 17 is tensioned by the slit 16 to open the lid effectively at the initial stage of the opening.

As described above, after the lid 20 is opened, the discharge plate 60 is pressed by the puff 80 to enable the pump 50 to be operated. At the initial use, the discharge plate 60 is locked by the locking structure not to actuate pumping operation, whereby the discharge of the contents is prevented before the initial use.

As described above, the locking structure of the discharge plate should be released at the initial use. As shown in FIG. 15, since the stop protrusion 61*a* of the discharge plate 60 is supported by being inserted into a space among the lower support protrusion 37*a*, the upper support protrusion 37*b*, and the side support protrusion 37*c* of the middle cap 35, the discharge plate is in the locked state where the downward movement and rotation of the discharge plate 60 are restricted, and in this state, the user forcibly rotates the discharge plate 60 in the direction of the side support protrusion 37*c*.

Here, as the side support protrusion 37*c* is tensioned inward and outward by the slit 37*d*, the stop protrusion 61*a* of the discharge plate is rotated to be separated from the supported state, wherein since the upper support protrusion 37*b* inserted in the stop groove 61*b* of the discharge plate is rotated to the position where rotation is restricted, the lower portion of the stop protrusion 61*a* of the discharge plate is completely separated from the lower support protrusion 37*a*, so as to be in the unlocked state where elastic downward movement is possible.

Herein, when the discharge plate 60 is forcibly rotated, the middle cap 35, the contents container 40, and the container main body 30 are prevented from being rotated since the knurling portion 18 of the outer container and the support protrusion 34 of the container main body are engaged with each other.

As described above, in the unlocked state, the discharge plate 60 is elastically pressed along with the puff 80 to enable the pump 50 to be operated, and thus, the cosmetic contents contained in the contents container 40 inside the container main body is discharged to be used.

To be more specific, in the process of the discharge plate 60 being elastically moved downward and restored upward by the elastic springs 71 and 72, by the pumping operation where the distribution plate 55 and the piston rod 53 are moved downward and then elastically moved upward, the check valve 51 opens the through-hole 36*a* formed through the bottom of the pump accommodating portion 36, and the contents container 40 inside the container main body is pressed to discharge the contents, whereby the contents are discharged to the distribution plate 55 and the discharge plate 60 through the through-hole 36*a* and the discharge path of the pump.

Here, the contents container 40 inside the container main body is made of stretchable material to be compressed by the pumping force of the pump, wherein the bottom of the contents container 40 is provided with the annular bent portion 43 formed to be bent upward and downward at a position outside the pump accommodating portion 36 of the lower center portion of the middle cap 35, and the lower edge thereof is provided with the rounded curved portion 42, whereby the contents are discharged while gradually inducing to be pressed from the rounded curved portion 42 of the lower edge rather than the central position where the bent portion of the contents container is formed.

In other words, since the contents container 40 is gradually pressed from the lower edge and then the bent portion 43 of the central portion is stretched and pressed gradually, the cosmetic contents of the contents container are induced to be pressed evenly and the discharge is induced.

In particular, since the contents container 40 is provided on the upper bottom surface thereof with the spaced protrusions 44 protruding radially, even when the bottom surface is pressed to be brought into close contact with the outer wall surface of the pump accommodating portion 36 of the middle cap, the gap t is provided between the contents container and the outer wall of the pump accommodating portion by the spaced protrusions, so that the final residual contents are induced to be smoothly discharged.

Further, as described above, the contents discharged by the pumping operation of the pump are discharged to the first branch passage 57*a* of the branch passage formed radially from the contents supply hole, and to the second branch passages 57*b* configured such that the second branch passages are branched in different directions at the end of the first branch passage, through the contents supply hole 56 at the center of the distribution plate 55 of the pump, and then at the end of the second branch passage, the contents are distributed and discharged to the contents discharge holes 63 of the discharge plate, whereby the cosmetic contents are evenly distributed and smeared on the entire lower portion of the puff 80 to be used.

As described above, the cosmetic contents are evenly smeared on the entire lower portion of the puff 80, so that the makeup application can be performed more efficiently.

Meanwhile, when all the cosmetic contents is used up through the above use method, instead of repurchase the entire container, the refill container 100, to which the container main body 30, the middle cap 35, the contents container 40, pump 50, and the discharge plate 60 are integrally coupled, can be coupled to the inside of the outer container 10 for refill use.

In other words, in the state where the lid 20 above the outer container 10 is opened, the completely used container main body 30, middle cap 35, contents container 40, pump 50, and the discharge plate 60 are pushed to be forcibly separated from the assembly hole 13 of the bottom of the outer container, and a new refill container 100 is coupled thereto.

As shown in FIG. 13, the refill container 100, to which the container main body 30, the middle cap 35, the contents container 40, pump 50, and the discharge plate 60 are integrally coupled, is inserted from the upper portion of the outer container 10 to the inside thereof.

Here, by forcibly inserting the ring-shaped coupling protrusion 32 formed on the outer lower side of the container main body 30 of the refill container 100 into the inclined portion 14*a* of the stop step 14 at the bottom of the outer container 10 by the rounded portion 32*a* of the lower edge, the seat protrusion 33 of the container main body is seated in the inner bottom of the outer container 10, whereby the coupling protrusion 32 is inserted into the assembly hole 13, and thus, the refill container is assembled to be prevented from separation by the stop step 14 and is reusable as described above.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

DESCRIPTION OF REFERENCE CHARACTERS OF IMPORTANT PARTS

10: outer container 11: assembly hole
12: button 13: assembly hole
14: stop step 14*a*: inclined portion
15: coupling ring body 16: slit
17: tension protrusion 18: knurling portion
20: lid 30: container main body
31: ventilation hole 32: coupling protrusion
32*a*: rounded portion 33: seat protrusion
34: support protrusion 35: middle cap
36: pump accommodating portion 37: support portion
37*a*: lower support protrusion 37*b*: upper support protrusion
37*c*: side support protrusion 37*d*: slit
40: contents container 41: space portion
42: rounded curved portion 43: annular bent portion
44: spaced protrusions 50: pump
55: distribution plate 56: contents supply hole
57: branch passage 57*a*: first branch passage
57*b*: second branch passage 60: discharge plate
61: stop portion 61*a*: stop protrusion
61*b*: stop groove 63: discharge holes
100: refill container

The invention claimed is:

1. A foundation container having a discharge pump therein, the foundation container comprising:

an outer container (10);

a lid (20) hinged to the outer container (10) to be opened and closed vertically;

a container main body (30) mounted in the outer container (10);

a pump (50) coupled to an upper center portion of the container main body (30); and a discharge plate (60) coupled to an upper portion of the pump (50), and formed with contents discharge holes (63), wherein the container main body (30) is provided with a ventilation hole (31) formed through a lower portion thereof, a contents container (40) of stretchable material having a space portion (41) for storing contents is inserted in the container main body, and an upper end of the contents container (40) is seated on an upper portion of the container main body to be fixedly coupled by a middle cap (35) coupled to the upper portion of the container main body, such that the contents container (40) is gradually pressed by pumping operation of the pump (50) by elastic pressing action of the discharge plate (60), so as to discharge the contents to the contents discharge holes (63) of the discharge plate, the contents container (40) is configured such that a lower edge thereof is provided with a rounded curved portion (42) and a bottom thereof is provided with at least one annular bent portion (43) formed to be bent upward and downward at a position outside a pump accommodating portion (36) of a lower center portion of the middle cap (35), so as to induce the contents container to be gradually pressed from the rounded curved portion thereof, and the contents container (40) is provided on an upper bottom surface thereof with spaced protrusions (44) protruding radially to form a gap (t) for discharging the contents from an outer wall surface of the pump accommodating portion (36) of the middle cap when the contents container is pressed.

2. The foundation container of claim 1, wherein the outer container (10) is coupled to a coupling ring body (15) to fix an inserted state of a button (12) for opening and closing the lid (20) in an assembly hole (11) formed at a front of the outer container, wherein the coupling ring body is integrally provided at a back thereof with a slit (16) cut in a circumferential direction, and a tension protrusion (17) protruding from a center of the slit to provide a tension force at an initial stage of opening the lid (20).

3. The foundation container of claim 1, wherein a distribution plate (55) coupled to an upper portion of a piston rod of the pump (50) is provided at an upper portion thereof with branch passages (57) formed radially at an equal angle interval from a contents supply hole (56) at a center of the distribution plate to discharge the contents evenly to the discharge plate, each of the branch passages having a first branch passage (57*a*) for guiding discharge of the contents from the contents supply hole (56), and at least two second branch passages (57*b*) configured such that the second branch passages are branched in different directions at an end of the first branch passage to guide discharge of the contents and the contents discharge holes (63) of the discharge plate are disposed to be aligned with end portions of the second branch passages.

4. The foundation container of claim 1, wherein a refill container (100) with the container main body (30), the middle cap (35), the contents container (40), the pump (50), and the discharge plate (60) coupled thereto is integrally provided and inserted in the outer container (10) for refill use, the outer container (10) is formed at a bottom thereof with an annular assembly hole (13), and a stop step (14) having an inclined portion (14*a*) inclined from an upper portion to a lower portion thereof at an upper edge of the assembly hole, and the container main body (30) includes: a ring-shaped coupling protrusion (32) provided on an outer lower side thereof to be inserted into an assembly hole (13) of the outer container to prevent separation, with a lower edge thereof formed with a rounded portion (32*a*); and a seat protrusion (33) provided at a position above the coupling protrusion to be seated in an inner bottom of the outer container (10).

5. The foundation container of claim 4, wherein the outer container (10) is further provided with a knurling portion (18) on a circumferential surface of a upper bottom thereof, and the seat protrusion (33) of the container main body (30) is further provided with a support protrusion (34) on a lower surface thereof to be engaged with the knurling portion (18) to prevent rotation.

6. The foundation container of claim 4, wherein the discharge plate (60) is provided on an outer side thereof radially at an equal angle interval with stop portions (61) each having a stop protrusion (61*a*) at a lower portion of the outer side and a stop groove (61*b*) at a position above the stop protrusion, and the middle cap (35) is provided on an outer side thereof radially at an equal angle interval to correspond to the stop portions (61) with support portions (37) each having a lower support protrusion (37*a*) for supporting the stop protrusion (61*a*) of the discharge plate to restrict rotation of the stop protrusion toward lower and first sides thereof, an upper support protrusion (37*b*) for supporting an upper portion of the discharge plate, and a side support protrusion (37*c*) for engagement with the stop portion (61) while being tensioned inward and outward by a slit (37*d*) formed on a second side thereof, whereby, at initial use, the stop portion (61) of the discharge plate is forcibly rotated to be separated from the side support protrusion (37*c*) of the support portion, such that the discharge plate is released from a locked state to enable the pump to be operated.

7. The foundation container of claim 1, wherein the discharge plate (60) is provided on an outer side thereof radially at an equal angle interval with stop portions (61) each having a stop protrusion (61*a*) at a lower portion of the outer side and a stop groove (61*b*) at a position above the stop protrusion, and the middle cap (35) is provided on an outer side thereof radially at an equal angle interval to correspond to the stop portions (61) with support portions (37) each having a lower support protrusion (37*a*) for supporting the stop protrusion (61*a*) of the discharge plate to restrict rotation of the stop protrusion toward lower and first sides thereof, an upper support protrusion (37*b*) for supporting an upper portion of the discharge plate, and a side support protrusion (37*c*) for engagement with the stop portion (61) while being tensioned inward and outward by a slit (37*d*) formed on a second side thereof, whereby, at initial use, the stop portion (61) of the discharge plate is forcibly rotated to be separated from the side support protrusion (37*c*) of the support portion, such that the discharge plate is released from a locked state to enable the pump to be operated.

* * * * *